US007254912B1

(12) United States Patent
Zigar

(10) Patent No.: US 7,254,912 B1
(45) Date of Patent: Aug. 14, 2007

(54) COMBINATION POST CARD PICTURE DISPLAY

(76) Inventor: Rhonda Zigar, 5555 Pleasant Creek Rd., Rogue River, OR (US) 97537

( * ) Notice: Subject to any disclaimer, the term of this patent is extended or adjusted under 35 U.S.C. 154(b) by 161 days.

(21) Appl. No.: 11/143,791

(22) Filed: Jun. 2, 2005

(51) Int. Cl.

| | |
|---|---|
| ***G09F 1/00*** | (2006.01) |
| ***A47G 1/16*** | (2006.01) |
| ***B65D 27/04*** | (2006.01) |
| ***B65D 27/00*** | (2006.01) |
| ***B65D 5/00*** | (2006.01) |
| ***B65D 85/00*** | (2006.01) |

(52) U.S. Cl. ..... 40/124.191; 40/754; 40/788; 40/789; 40/798; 40/750; 229/103.2; 229/143; 229/71; 229/92.3; 206/459.5

(58) Field of Classification Search ..... 40/124.191, 40/124.08, 124.19, 124.06, 124.01, 124.09, 40/124.14, 124.16, 539, 610, 661.08, 754, 40/764, 786, 755, 756; 229/92.8
See application file for complete search history.

(56) References Cited

U.S. PATENT DOCUMENTS

| | | | | |
|---|---|---|---|---|
| 1,839,814 | A * | 1/1932 | Taylor | 40/750 |
| 4,450,638 | A | 5/1984 | Bader | |
| 5,513,455 | A * | 5/1996 | Walker | 40/788 |
| 5,678,339 | A | 10/1997 | Marventano | |
| 5,822,897 | A | 10/1998 | Ertzan | |
| 5,873,603 | A | 2/1999 | Carless et al. | |
| 5,934,549 | A * | 8/1999 | Baumgartner et al. | 229/103.2 |
| 6,082,033 | A * | 7/2000 | Skinner | 40/750 |
| 6,163,998 | A * | 12/2000 | James | 40/755 |
| 6,427,371 | B2 | 8/2002 | Olson et al. | |
| 6,481,125 | B1 | 11/2002 | Pokrasoff | |
| 6,493,970 | B1 | 12/2002 | McCarth et al. | |
| 6,694,657 | B2 | 2/2004 | Tsao | |

* cited by examiner

*Primary Examiner*—Lesley D. Morris
*Assistant Examiner*—Syed A. Islam
(74) *Attorney, Agent, or Firm*—Gerald D Haynes; R. Keith Harrison

(57) ABSTRACT

A combination postcard picture display is disclosed. The combination postcard picture display includes a postcard panel typically having a photograph or image, a display stand cutout which is detachable from the postcard panel, and a self-supporting display stand which is formable from the display stand cutout to display the photograph or image.

7 Claims, 2 Drawing Sheets

COMBINATION POST CARD PICTURE DISPLAY

FIELD OF THE INVENTION

The present invention relates to postcards. More particularly, the present invention relates to a postcard which is capable of being folded into a display stand to display an image or picture on the postcard.

BACKGROUND OF THE INVENTION

Postcards having pictures of a resort, city or other tourist destination are frequently purchased by vacationers and mailed to friends and family to commemorate a vacation. Typically, a postcard includes a rectangular or otherwise-shaped piece of cardboard or thick paper having a front surface on which is provided an image or photograph of interest and a rear surface on which is provided a writing area for writing the address of the addressee as well as a written message to the addressee. Information about the image or photograph which appears on the front surface of the postcard may also be provided on the rear surface of the postcard.

After receiving the postcard typically through the mail, the addressee may wish to display the postcard in some manner in his or her home. Since the postcard is typically a flat sheet of cardboard or paper, the postcard is usually not self-standing. Therefore, the locations around the home in which the postcard may be displayed are limited because the postcard must typically be attached to a magnetized surface such as a refrigerator using magnets, for example, or alternatively, must be leaned against a support and supported on a flat surface such as a mantel.

Therefore, a postcard which is capable of being converted into a display stand to display a drawing or photograph on the postcard is needed.

SUMMARY OF THE INVENTION

The present invention is generally directed to a combination postcard picture display. The combination postcard picture display includes a postcard panel typically having a photograph or image, a display stand cutout which is detachable from the postcard panel, and a self-supporting display stand which is formable from the display stand cutout to display the photograph or image.

BRIEF DESCRIPTION OF THE DRAWINGS

The invention will now be described, by way of example, with reference to the accompanying drawings, in which.

DETAILED DESCRIPTION OF THE INVENTION

Figure 4:
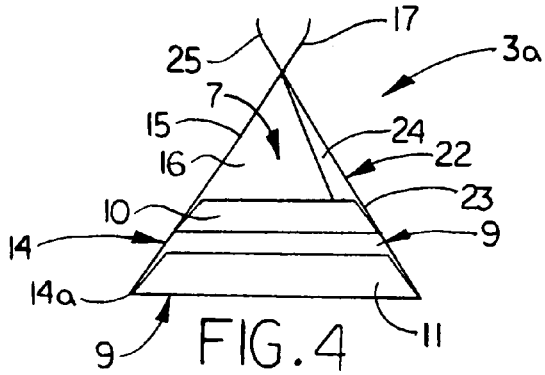
FIG. 4 is a bottom view of the display stand of the combination postcard picture display.
Figure 5:
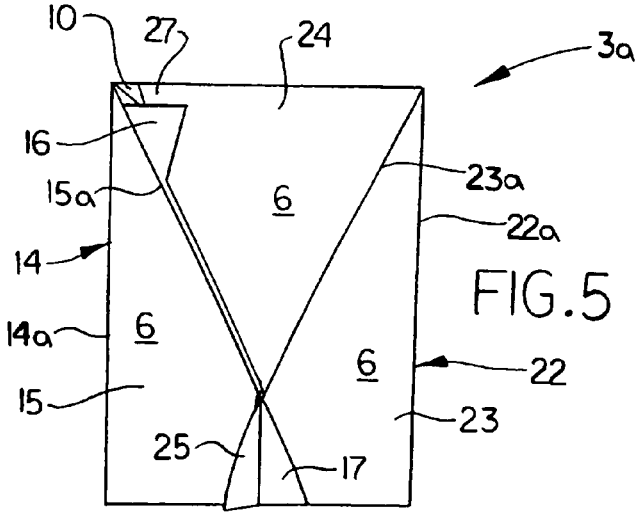
FIG. 5 is a rear view of the display stand of the combination postcard picture display.
Figure 6:
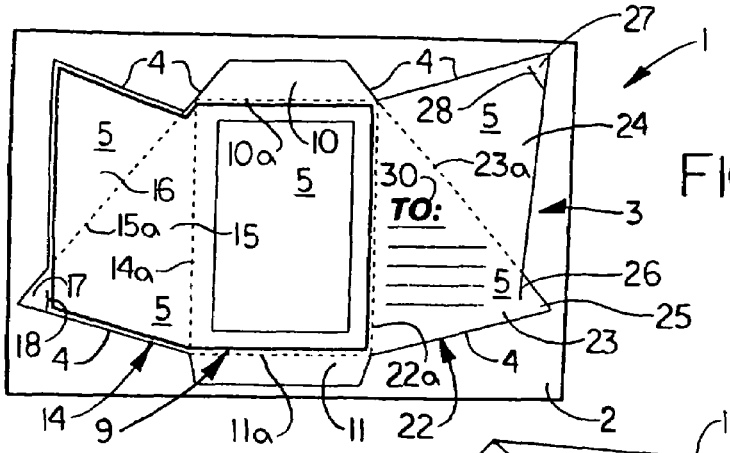
FIG. 6 is a rear view of the combination postcard picture display, with the display stand cutout incorporated into the postcard.

Referring initially to FIGS. 1-6 of the drawings, an illustrative embodiment of the combination postcard picture display according to the present invention is generally indicated by reference numeral 1 in FIG. 6. The combination postcard picture display 1 includes a postcard panel 2 which may have a generally elongated, rectangular shape, as shown, or may be any desired alternative shape. The postcard panel 2 may be cardboard or any other rigid or semi-rigid paper material which is suitable for postcards and has a rear surface 5 and a front surface 6. A display stand cutout 3 is provided in the postcard panel 2 and is delineated by a cutout boundary 4 which is provided typically on the rear surface 5 of the postcard panel 2. When incorporated in the postcard panel 2, the display stand cutout 3 is preferably generally coplanar with respect to the postcard panel 2. Address lines and/or insignia 30 may be printed on the rear surface 5 of the display stand cutout 3 or elsewhere on the postcard panel 2 to facilitate addressing the postcard panel 2 to an addressee.

Figure 1:
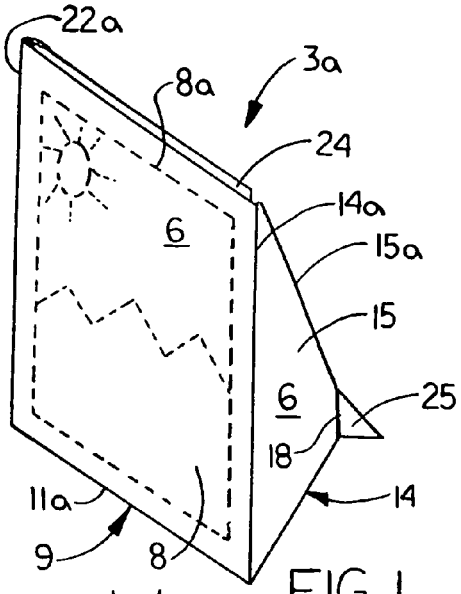
FIG. 1 is a front perspective view of an illustrative embodiment of the combination postcard picture display according to the present invention, with the display stand cutout removed from the postcard and folded into a display stand.
Figure 2:
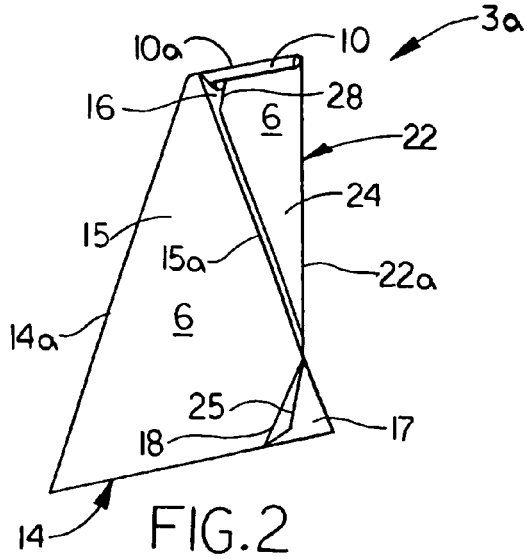
FIG. 2 is a rear perspective view of the display stand of the combination postcard picture display.
Figure 3:
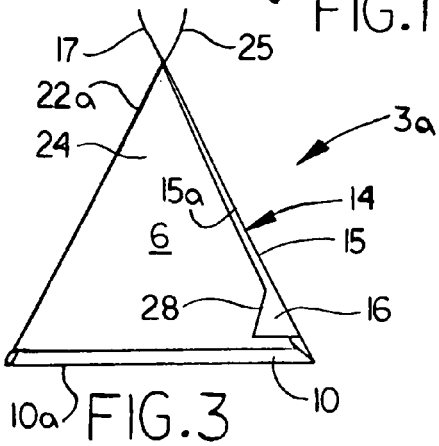
FIG. 3 is a top view of the display stand of the combination postcard picture display.

As will be hereinafter described, the display stand cutout 3 may be selectively removed from the postcard panel 2 and folded into a display stand 3*a* to display a photograph or image 8 which appears on the front surface 6 of the postcard panel 2, as illustrated in FIG. 1. Alternatively, the postcard panel 2 may be cut along an image boundary 8*a* which surrounds the photograph or image 8 to facilitate placement of a photograph (not illustrated) on the display stand 3*a* for display of the photograph, as will be hereinafter further described. The display stand cutout 3 may be attached to the postcard panel 2 through perforations (not illustrated) which extend along the cutout boundary 4, or alternatively, may be one continuous piece with the postcard panel 2. In the latter case, the display stand cutout 3 may be removed from the postcard panel 2 by cutting along the cutout boundary 4 using scissors or other suitable cutting implement (not illustrated). Cutout and folding directions (not illustrated) may be provided on the rear surface 5 of the display stand cutout 3 to assist in folding of the display stand cutout 3 into the display stand 3*a*.

As illustrated in FIG. 6, the display stand cutout 3 typically includes a central portion 9 which may have a generally rectangular shape, as shown. The photograph or image 8 typically appears on the front surface 6 of the central portion 9, as illustrated in FIG. 1. An upper tab 10 is attached to the upper edge of the central portion 9 along a fold line 10*a*. Similarly, a lower tab 11 is attached to the lower edge of the central portion 9 along a fold line 11*a*.

A left folding flap 14, which typically has a generally rectangular shape, includes a generally triangular bottom portion 15 which is attached to the left edge of the central portion 9 along a fold line 14*a*. A generally triangular top portion 16 of the left folding flap 14 is attached to the bottom portion 15 along a diagonal fold line 15*a*. A left flap tab 17 is provided at the bottom corner of the left folding flap 14, and a slit 18 is provided in the left flap tab 17.

A right folding flap 22, which typically has a generally rectangular shape, includes a generally triangular bottom portion 23 which is attached to the right edge of the central portion 9 along a fold line 22*a*. A generally triangular top portion 24 of the right folding flap 22 is attached to the bottom portion 23 along a diagonal fold line 23*a*. A bottom flap tab 25 is provided at the bottom corner of the right folding flap 22, and a bottom slit 26 is provided in the bottom flap tab 25. A top flap tab 27 is provided at the top corner of the right folding flap 22, and a top slit 28 is provided in the top flap tab 27.

Referring next to FIGS. 1-9 of the drawings, in typical use of the invention, the combination postcard picture display 1 is sold, typically in the unfolded configuration illustrated in FIG. 6, at retail outlets such as those at a tourist destination, for example. The photograph or image 8 which appears on the front surface 6 of the central portion 9 of the display stand cutout 3 may be that of a scenic attraction or other item or feature of interest at the tourist destination, for example. The purchaser of the combination postcard picture display 1 addresses the combination postcard picture display 1 to an addressee typically by writing the name and address of the addressee on the address insignia 30 which may provided on the rear surface 5 of the right folding flap 22, illustrated in FIG. 6, or elsewhere on the postcard panel 2. Accordingly, the combination postcard picture display 1 is typically mailed to the addressee in the unfolded configuration illustrated in FIG. 6.

After he or she receives the combination postcard picture display 1 in the mail, the addressee may desire to convert the combination postcard picture display 1 into the free-standing display stand 3*a* in order to display the photograph or image 8 provided on the front surface 6 of the central portion 9 of the display stand 3*a*, as illustrated in FIG. 1. Alternatively, the photograph or image 8 may be cut or removed from the display stand cutout 3 along the image boundary 8*a* to facilitate the display of a SEND & BEND (trademark) type specialty picture, for example, or a picture or image of the user's choice in place of the photograph or image 8. The combination postcard picture display 1 is converted into the display stand 3*a* by initially removing the display stand cutout 3 from the postcard panel 2. This is accomplished by either tearing the display stand cutout 3 away from the postcard panel 2 along the perforations (not illustrated) which are spaced along the cutout boundary 4 (in the event that the display stand cutout 3 is attached to the postcard panel 2 by perforations), or cutting the display stand cutout 3 from the postcard panel 2 along the cutout boundary 4 using scissors or other cutting implement (not illustrated).

Figure 7:
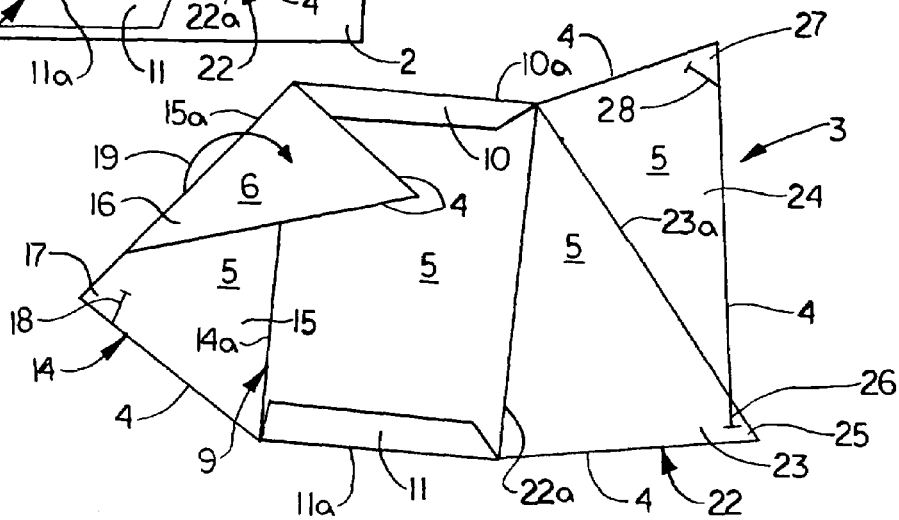
FIGS. 7-9 illustrate sequential folding of the display stand cutout to form the display stand of the combination postcard picture display according to the present invention.
Figure 8:
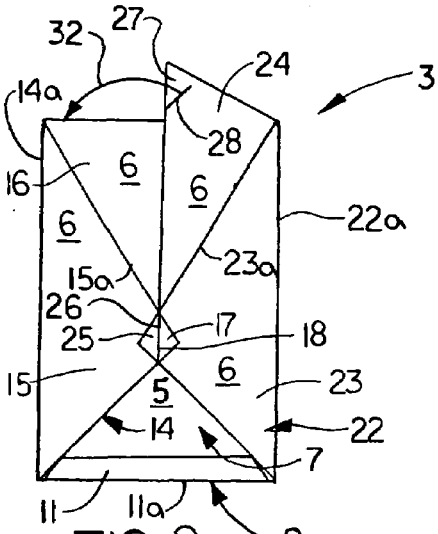
Figure 9:
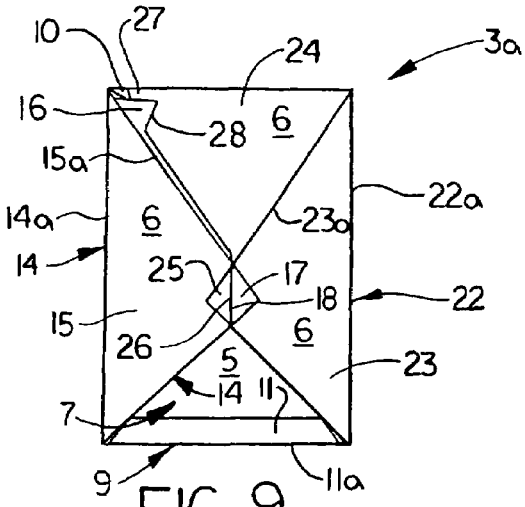

Next, as illustrated in FIG. 7, the upper tab 10 and the lower tab 11 are folded along the fold line 10*a* and fold line 11*a*, respectively, toward the rear surface 5 of the central portion 9 of the display stand cutout 3. The top portion 16 of the left folding flap 14 is then folded along the fold line 15*a*, toward the rear surface 5 of the bottom portion 15 of the left folding flap 14, as indicated by the arrow 19 in FIG. 7. Next, the bottom portion 15 of the left folding flap 14 is folded along the fold line 14*a*, toward the rear surface 5 of the central portion 9 such that the top portion 16 of the left folding flap 14 extends over the upper tab 10, as illustrated in FIGS. 5, 8 and 9. The bottom portion 23 of the right folding flap 22 is then folded along the fold line 22*a*, toward the inwardly-folded left folding flap 14, and the top portion 24 of the right folding flap 22 is folded along the fold line 23*a*, toward the left folding flap 14.

As further illustrated in FIG. 8, the slit 18 in the left flap tab 17 of the left folding flap 14 is inserted in the bottom slit 26 in the bottom flap tab 25 of the right folding flap 22 such that the left flap tab 17 and bottom flap tab 25 intersect and are disposed in generally perpendicular relationship to each other, as further illustrated in FIGS. 2-5. Finally, as indicated by the arrow 32 in FIG. 8, the top slit 28 in the top flap notch 27 of the right folding flap 22 receives the upper edge of the top portion 16 of the left folding flap 14, to secure the right folding flap 22 against the left folding flap 14, as illustrated in FIGS. 2, 3, 5 and 9.

As illustrated in FIG. 4, in the folded and free-standing display stand 3*a*, the left folding flap 14 and the right folding flap 22 extend from opposite edges of the central portion 9 and interlock with each other at the left flap tab 17 and bottom flap tab 25 to impart a generally triangular configuration to the display stand 3*a*. As further illustrated in FIG. 4, the central portion 9, the left folding flap 14 and the right folding flap 22 define a stand interior 7 in the display stand 3*a*. As illustrated in FIGS. 1-6, the rearwardly-extending left folding flap 14 and right folding flap 22 are capable of supporting the display stand 3*a* in a free-standing position on a flat support surface (not illustrated) such as a table, mantle or the like, with the photograph or image 8 displayed on the front surface 6 of the central portion 9. The left flap tab 17 and bottom flap tab 25 stabilize the rearwardly-leaning display stand 3*a* on the support surface.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A combination postcard picture display, comprising:

a postcard panel;

a display stand cutout detachable from said postcard panel, wherein said display stand cutout comprises a central portion and a first folding flap and a second folding flap carried by said central portion and said first folding flap comprises a first folding flap bottom portion and a first folding flap top portion carried by said first folding flap bottom portion, and said second folding flap comprises a second folding flap bottom portion and a second folding flap top portion carried by said second folding flap bottom portion;

a self-supporting display stand formable from said display stand cutout;

a first flap tab carried by said first folding flap and a second flap tab carried by said second folding flap for attachment to said first flap tab in said display stand; and a first slit provided in said first flap tab and a second slit provided in said second flap tab for receiving said first slit in said display stand.

2. The combination postcard picture display of claim 1 further comprising a third flap tab carried by said second folding flap for attachment to said first folding flap in said display stand.

3. The combination postcard picture display of claim 2 further comprising a slit provided in said third flap tab for receiving said first folding flap in said display stand.

4. A combination postcard picture display, comprising:

a postcard panel;

a display stand cutout detachable from said postcard panel, said display stand cutout having a central portion and first and second folding flaps carried by said central portion, wherein said first folding flap comprises a first folding flap bottom portion and a first folding flap top portion foldable with respect to said first folding flap bottom portion, and wherein said second folding flap comprises a second folding flap bottom portion and a second folding flap top portion foldable with respect to said second folding flap bottom portion;

a self-supporting display stand formable from said display stand cutout, wherein said first and second folding flaps are folded with respect to said central portion and said first folding flap engages said second folding flap in said display stand;

a photograph or image provided on said central portion of said display stand cutout; and a first flap tab having a first slit carried by said first folding flap and a second flap tab having a second slit carried by said second folding flap and wherein said first slit receives said second slit in formation of said display stand.

5. The combination postcard picture display of claim 4 further comprising a third flap tab having a third slit carried by said second folding flap and wherein said third slit receives said first folding flap in formation of said display stand.

6. A combination postcard picture display, comprising:

a generally elongated, rectangular postcard panel;

a display stand cutout generally coplanar to and detachable from said postcard panel, said display stand cutout having a generally rectangular central portion and first and second folding flaps foldable with respect to said central portion, wherein said first folding flap comprises a generally triangular first folding flap with a bottom portion and a generally triangular first folding flap with a top portion foldable with respect to said first folding flap bottom portion, and wherein said second folding flap comprises a generally triangular second folding flap with a bottom portion and a generally triangular second folding flap with a top portion foldable with respect to said second folding flap bottom portion;

a self-supporting display stand formable from said display stand cutout; and wherein said first and second folding flaps are folded with respect to said central portion and said first folding flap engages said second folding flap in formation of said display stand; and a first flap tab having a first slit carried by said first folding flap bottom portion and a second flap tab having a second slit carried by said second folding flap bottom portion and wherein said first slit receives said second slit in formation of said display stand.

7. The combination postcard picture display of claim 6 further comprising a third flap tab having a third slit carried by said second folding flap top portion and wherein said third slit receives said first folding flap top portion in formation of said display stand.

* * * * *